US009045310B2

(12) United States Patent
Hata et al.

(10) Patent No.: US 9,045,310 B2
(45) Date of Patent: Jun. 2, 2015

(54) SHEET PROCESSING APPARATUS, IMAGE FORMING SYSTEM, AND METHOD OF ENHANCING FOLDING OF SHEET BUNDLE

(71) Applicants: Kiyoshi Hata, Tokyo (JP); Keisuke Sugiyama, Tokyo (JP); Atsushi Kikuchi, Kanagawa (JP); Tomomichi Hoshino, Kanagawa (JP); Mamoru Kambayashi, Tokyo (JP); Shohichi Satoh, Kanagawa (JP); Makoto Hidaka, Tokyo (JP); Satoshi Saito, Kanagawa (JP)

(72) Inventors: Kiyoshi Hata, Tokyo (JP); Keisuke Sugiyama, Tokyo (JP); Atsushi Kikuchi, Kanagawa (JP); Tomomichi Hoshino, Kanagawa (JP); Mamoru Kambayashi, Tokyo (JP); Shohichi Satoh, Kanagawa (JP); Makoto Hidaka, Tokyo (JP); Satoshi Saito, Kanagawa (JP)

(73) Assignee: Ricoh Comapny, Limited, Tokyo (JP)

( * ) Notice: Subject to any disclaimer, the term of this patent is extended or adjusted under 35 U.S.C. 154(b) by 0 days.

(21) Appl. No.: 14/020,961

(22) Filed: Sep. 9, 2013

(65) Prior Publication Data

US 2014/0077436 A1 Mar. 20, 2014

(30) Foreign Application Priority Data

Sep. 18, 2012 (JP) ..... 2012-204755

(51) Int. Cl.
*B65H 45/12* (2006.01)
*B65H 45/04* (2006.01)
(Continued)

(52) U.S. Cl.
CPC ..... *B65H 45/12* (2013.01); *B65H 45/04* (2013.01); *B31F 1/00* (2013.01); *B31F 1/0035* (2013.01); *B65H 37/04* (2013.01); *B65H 37/06* (2013.01); *B65H 45/18* (2013.01); *B65H 2701/13212* (2013.01); *B65H 2801/27* (2013.01)

(58) Field of Classification Search
CPC ..... B31F 1/00; B31F 1/006; B31F 1/0035; B65H 45/04; B65H 45/12; B65H 2801/27
USPC ..... 270/32, 45, 58.07
See application file for complete search history.

(56) References Cited

U.S. PATENT DOCUMENTS 7,285,084 B2 10/2007 Fujimoto et al.
7,922,162 B2 * 4/2011 Kamiya ..... 270/45
(Continued)

FOREIGN PATENT DOCUMENTS

EP 2 065 326 6/2009
EP 2 090 537 8/2009
(Continued)

OTHER PUBLICATIONS

Extended European Search Report dated Dec. 20, 2013.
(Continued)

*Primary Examiner* — Leslie A Nicholson, III
(74) *Attorney, Agent, or Firm* — Harness, Dickey & Pierce P.L.C.

(57) ABSTRACT

A sheet processing apparatus includes: a folding unit that folds a sheet bundle; a pressing unit that presses a fold part of the sheet bundle, which has been folded by the folding unit, in a thickness direction of the sheet bundle to enhance folding of the fold part; and a moving unit that advances and returns the pressing unit in a width direction of the sheet bundle. The pressing unit starts pressing from a predetermined position in the width direction of the sheet bundle during advancing movement, and releases pressing after going past one end of the sheet bundle. The pressing unit starts pressing from the predetermined position during return movement and goes past the other end of the sheet bundle.

9 Claims, 12 Drawing Sheets

(51) Int. Cl.

| | |
|---|---|
| ***B31F 1/00*** | (2006.01) |
| ***B65H 37/06*** | (2006.01) |
| *B65H 37/04* | (2006.01) |
| *B65H 45/18* | (2006.01) |

(56) References Cited

U.S. PATENT DOCUMENTS

| | | | | |
|---|---|---|---|---|
| 7,950,643 | B2 * | 5/2011 | Kawaguchi | 270/37 |
| 8,083,218 | B2 * | 12/2011 | Dobashi et al. | 270/45 |
| 8,432,497 | B2 * | 4/2013 | Lee et al. | 348/723 |
| 2008/0315481 | A1 | 12/2008 | Iguchi et al. | |
| 2008/0315482 | A1 | 12/2008 | Iguchi et al. | |
| 2008/0315483 | A1 | 12/2008 | Iguchi et al. | |
| 2008/0315484 | A1 | 12/2008 | Iguchi et al. | |
| 2008/0315485 | A1 | 12/2008 | Iguchi et al. | |
| 2008/0315486 | A1 | 12/2008 | Iguchi et al. | |
| 2008/0315487 | A1 | 12/2008 | Iguchi et al. | |
| 2008/0315488 | A1 | 12/2008 | Iguchi et al. | |
| 2009/0200725 | A1 | 8/2009 | Tamura et al. | |
| 2010/0219575 | A1 | 9/2010 | Iguchi et al. | |
| 2010/0239393 | A1 | 9/2010 | Suzuki et al. | |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0057375 | A1 | 3/2011 | Iguchi et al. | |
| 2011/0064541 | A1 | 3/2011 | Kikkawa et al. | |
| 2011/0091259 | A1 | 4/2011 | Kobayashi et al. | |
| 2011/0103919 | A1 | 5/2011 | Furuhashi et al. | |
| 2011/0103921 | A1 | 5/2011 | Suzuki et al. | |
| 2011/0156333 | A1 | 6/2011 | Iguchi et al. | |
| 2011/0176849 | A1 * | 7/2011 | Abe | 399/408 |
| 2011/0181917 | A1 | 7/2011 | Iguchi et al. | |
| 2011/0229287 | A1 | 9/2011 | Suzuki | |
| 2011/0278784 | A1 | 11/2011 | Iguchi et al. | |
| 2012/0027428 | A1 * | 2/2012 | Terao | 399/21 |
| 2012/0087765 | A1 | 4/2012 | Suzuki | |

FOREIGN PATENT DOCUMENTS

| | | |
|---|---|---|
| JP | 2003-341930 | 12/2003 |
| JP | 2007-045531 | 2/2007 |
| JP | 2009-001428 | 1/2009 |
| JP | 2009-190824 | 8/2009 |

OTHER PUBLICATIONS

U.S. Office Action for U.S. Appl. No. 14/151,955 dated Jan. 30, 2015.

* cited by examiner

SHEET PROCESSING APPARATUS, IMAGE FORMING SYSTEM, AND METHOD OF ENHANCING FOLDING OF SHEET BUNDLE

CROSS-REFERENCE TO RELATED APPLICATIONS

The present application claims priority to and incorporates by reference the entire contents of Japanese Patent Application No. 2012-204755 filed in Japan on Sep. 18, 2012.

BACKGROUND OF THE INVENTION

1. Field of the Invention

The present invention relates to a sheet processing apparatus, an image forming system, and a method of enhancing folding of a sheet bundle, and particularly to a sheet processing apparatus including a folding processing unit for folding a sheet-like recording medium such as paper, recording paper, or transfer paper (hereinafter referred to as "sheet" simply in this specification), an image forming system including the sheet processing apparatus, and a method of enhancing folding of a sheet bundle executed in the sheet processing apparatus.

2. Description of the Related Art

Some pieces of conventional post-processing apparatus used in combination with an image forming apparatus such as a copier produce saddle-stitched booklets in a manner that a sheet central part of a sheet or a plurality of sheets is bound and a central part of a sheet bundle is folded using a folding roller pair installed in parallel to the sheet folding direction. A technique is also known for sharpening the fold of the saddle-stitched booklet by enhancing folding of the sheet bundle with a roller moving along the back of the booklet.

In such a technique of enhancing folding, folding-enhancement rollers standing-by outside the booklet is put on the back (fold part) of the booklet (sheet bundle) for enhancing folding of the back of the booklet by the rollers; however, an end of the booklet may be damaged on this occasion. Further, when the rollers are moved from one end to the other end of the back of the booklet, the rollers run by the distance corresponding to the width of the paper forming the booklet; therefore, the twist is accumulated so that a crease or the like is easy to occur.

As a technique for dealing with this problem, for example, Japanese Laid-open Patent Publication No. 2009-1428 suggests a sheet post-processing apparatus capable of sharpening a fold with a sufficient amount of pressure without generating a curl or a crease at or near the fold part.

The invention of Japanese Laid-open Patent Publication No. 2009-1428 includes a saddle-stitching unit for binding a central part of a sheet bundle, a center-folding unit for forming a fold by folding the central part, first and second rollers for sharpening the fold by moving along a direction of the fold while pressing the sheet bundle conveyed from the center-folding unit with the fold of the sheet bundle interposed between the rollers, and a driving unit for moving the first and second rollers in a direction along the fold from a standby position away from an end of the sheet bundle. The first roller and the second roller are separated from each other at the standby position, and approach to each other in a region of the fold of the sheet bundle to have the fold interposed therebetween.

That is, Japanese Laid-open Patent Publication No. 2009-1428 discloses a structure in which, when the back of the sheet bundle (fold part) is folding-enhanced by the roller pair, a nip is released at a position where the sheet bundle does not present and the sheet bundle is nipped at a position where the sheet bundle presents, thereby reducing the damage on the end of the paper bundle (sheet bundle).

However, since the sheet bundle is folding-enhanced from one end to the other end of the sheet bundle without pausing, the twist that would cause the crease or the like are accumulated, which may result in the generation of the curl or crease at or near the fold part.

In view of this, there is a need to suppress the curl or crease generated at or near the fold part due to the accumulation of the twist without damaging the end of the sheet bundle when the sheet bundle is folding-enhanced.

SUMMARY OF THE INVENTION

It is an object of the present invention to at least partially solve the problems in the conventional technology.

A sheet processing apparatus includes: a folding unit that folds a sheet bundle; a pressing unit that presses a fold part of the sheet bundle, which has been folded by the folding unit, in a thickness direction of the sheet bundle to enhance folding of the fold part; and a moving unit that advances and returns the pressing unit in a width direction of the sheet bundle. The pressing unit starts pressing from a predetermined position in the width direction of the sheet bundle during advancing movement, and releases pressing after going past one end of the sheet bundle. The pressing unit starts pressing from the predetermined position during return movement and goes past the other end of the sheet bundle.

An image forming system includes a sheet processing apparatus. The sheet processing apparatus includes: a folding unit that folds a sheet bundle; a pressing unit that presses a fold part of the sheet bundle, which has been folded by the folding unit, in a thickness direction of the sheet bundle to enhance folding of the fold part; and a moving unit that advances and returns the pressing unit in a width direction of the sheet bundle. The pressing unit starts pressing from a predetermined position in the width direction of the sheet bundle during advancing movement, and releases pressing after going past one end of the sheet bundle. The pressing unit starts pressing from the predetermined position during return movement and goes past the other end of the sheet bundle.

A method of enhancing folding of a sheet bundle in a sheet processing apparatus including a folding unit that folds a sheet bundle, a pressing unit that presses a fold part of the sheet bundle, which has been folded by the folding unit, in a thickness direction of the sheet bundle to enhance folding of the fold part, and a moving unit that advances and returns the pressing unit in a width direction of the sheet bundle, the method includes: a first step of moving the pressing unit to a vicinity of a central part of the sheet bundle in one direction in a pressure-released state and pressing; a second step of moving the pressing unit in the one direction in a pressed state in the first step and stopping the pressing unit after going past the sheet bundle; a third step of bringing the pressing unit into the pressure-released state after the second step, moving the pressing unit in the other direction to the vicinity of the central part of the sheet bundle in the pressure-released state, and pressing; and a fourth step of moving the pressing unit in the other direction in the pressed state in the third step and stopping the pressing unit after the pressing unit goes past the sheet bundle.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a side view of the main part, in which FIG. 7 is seen from the left side;

DETAILED DESCRIPTION OF THE PREFERRED EMBODIMENTS

The present invention provides the following steps:

(1) moving folding-enhancement rollers to the vicinity of the central part of a sheet bundle in a pressure-released state, and then pressing the sheet bundle;

(2) stopping the folding-enhancement rollers at a position where the folding-enhancement rollers have moved in a width direction of the sheet bundle in a pressed state and gone past the sheet bundle;

(3) placing the folding-enhancement rollers in the pressure-released state again, moving the folding-enhancement rollers to the vicinity of the central part of the sheet bundle, then pressing the sheet bundle, and stopping the folding-enhancement rollers at a position where the folding-enhancement rollers have moved in the width direction of the sheet bundle in the pressed state and gone past the sheet bundle; and (4) as in the steps (1) to (3), advancing and returning the roller pair relative to the sheet bundle and enhancing folding of the sheet bundle by the half of the width of the sheet bundle in each of the advancing movement and the return movement.

An embodiment of the present invention is hereinafter described with reference to the drawings.

Figure 1:
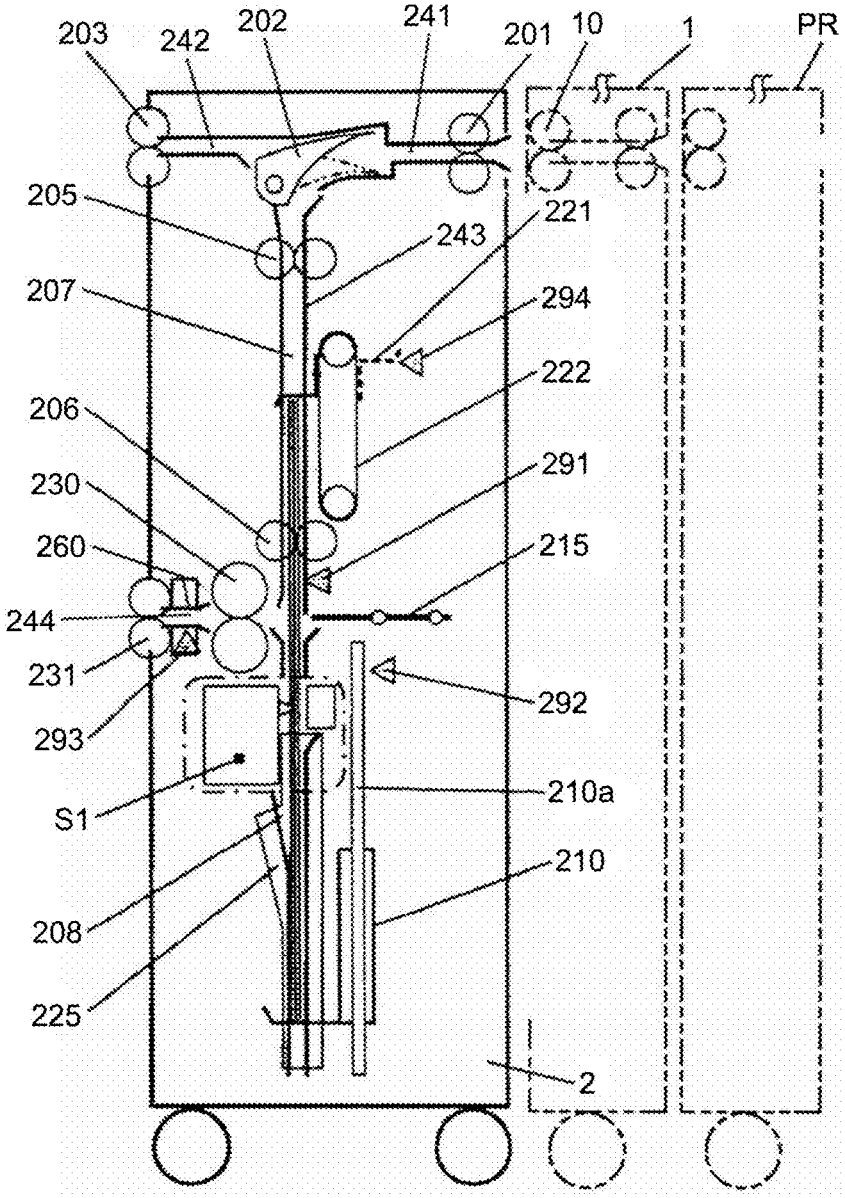
FIG. 1 illustrates a system configuration of an image processing system including an image forming apparatus and a plurality of sheet processing apparatuses according to an embodiment of the present invention.

FIG. 1 illustrates a system configuration of an image processing system including an image forming apparatus and a plurality of sheet processing apparatuses according to this embodiment. In this embodiment, first and second sheet post-processing apparatuses 1 and 2 are connected in this order at the subsequent stage of an image forming apparatus PR.

The first sheet post-processing apparatus 1 has a sheet bundle forming function of receiving sheets one by one from the image forming apparatus PR, stacking and aligning the sheets sequentially, and forming a sheet bundle in a stack portion. The first sheet post-processing apparatus 1 discharges the sheet bundle toward the second sheet post-processing apparatus 2 at the subsequent stage through sheet bundle discharging rollers 10. The second sheet post-processing apparatus 2 is a saddle-stitching bookbinding apparatus for saddle-stitching and center-folding the sheet bundle after receiving the conveyed sheet bundle (in this specification, the second sheet post-processing apparatus is also referred to as a saddle-stitching bookbinding apparatus).

The saddle-stitching bookbinding apparatus 2 discharges the bound booklet (sheet bundle) as it is, or discharges the booklet to a sheet processing apparatus at the subsequent stage. The image forming apparatus PR forms a visible image on a sheet-like recording medium on the basis of the input image data or the image data of the scanned image. For example, the image forming apparatus PR corresponds to a copier, a printer, a facsimile, a digital MFP having at least two functions of these, or the like. The image forming apparatus PR employs a known method such as an electrophotography method or a liquid droplet ejecting method, and any image forming method may be employed.

In the drawing, the saddle-stitching bookbinding apparatus 2 includes an entrance conveying path 241, a sheet through conveying path 242, and a center-folding conveying path 243. The most upstream part of the entrance conveying path 241 in the sheet conveying direction is provided with entrance rollers 201, and the aligned sheet bundle is conveyed into the apparatus from the sheet bundle discharging rollers 10 of the first sheet post-processing apparatus 1. In the description below, the upstream in the sheet conveying direction and the downstream in the sheet conveying direction are hereinafter simply referred to as the upstream and the downstream, respectively.

A branch claw 202 is provided downstream of the entrance rollers 201 of the entrance conveying path 241. This branch claw 202 is installed in a horizontal direction in the drawing, and causes the sheet bundle conveying direction to branch into the sheet through conveying path 242 and the center-folding conveying path 243. The sheet through conveying path 242 extends horizontally from the entrance conveying path 241, and guides the sheet bundle to a paper discharging tray or a processing apparatus at the subsequent stage, which is not illustrated. The sheet bundle is discharged to the subsequent stage by upper discharging rollers 203. The center-folding conveying path 243 extends vertically downward from the branch claw 202, and is to saddle-stitch and center-fold the sheet bundle.

The center-folding conveying path 243 includes a bundle conveying upper guide plate 207 for guiding the sheet bundle above a folding plate 215 for center folding, and a bundle conveying lower guide plate 208 for guiding the sheet bundle below the folding plate 215. The sheet conveying guide plate 207 includes, from the upper, bundle conveying upper rollers 205, a trailing-end hitting claw 221, and bundle conveying lower rollers 206. The trailing-end hitting claw 221 is erected on a trailing-end hitting claw driving belt 222 driven by a driving motor, which is not illustrated. With the reciprocation rotation operation of the driving belt 222, the trailing-end hitting claw 221 hits (presses) the trailing end of the sheet bundle toward a movable fence, which is described later, thereby performing the operation of aligning the sheet bundle. When the sheet bundle is conveyed in and when the sheet bundle is lifted up for the center folding, the claw 221 retracts from the center-folding conveying path 243 of the bundle conveying upper guide plate 207 (position illustrated by the dotted line in FIG. 1).

A reference symbol 294 denotes a trailing-end hitting claw HP sensor for detecting the home position of the trailing-end hitting claw 221, and detects the position shown by the dotted line in FIG. 1 (position shown by a solid line in FIG. 2) at which the trailing-end hitting claw 221 retracts from the center-folding conveying path 243, as the home position. The trailing-end hitting claw 221 is controlled based on this home position.

The bundle conveying lower guide plate 208 includes, from the upper, a saddle-stitching stapler S1, a saddle-stitching jogger fence 225, and a movable fence 210. The bundle conveying lower guide plate 208 is a guide plate receiving the sheet bundle conveyed through the bundle conveying upper guide plate 207, a pair of saddle-stitching jogger fences 225 is provided in the width direction thereof, and the movable fence 210 is provided so that an end of the sheet bundle abuts on (is supported by) the lower thereof and the movable fence 210 can move vertically.

The saddle-stitching stapler 51 is a stapler for binding the central part of the sheet bundle. The movable fence 210 moves vertically in a state in which it supports the end of the sheet bundle. With the center of the sheet bundle positioned opposite to the saddle-stitching stapler 51, the stapling process, i.e., saddle-stitching is performed at that position. The movable fence 210 is supported by a movable fence driving mechanism 210*a*, and can move from the position of a movable fence HP sensor 292 located at the upper to the lowermost position in the drawing. As for the movable range of the movable fence 210 on which the end of the sheet bundle abuts, a stroke capable of dealing with the size from the maximum size to the minimum size for which the saddle-stitching bookbinding apparatus 2 can perform processing is secured. As the movable fence driving mechanism 210*a*, for example, a rack and pinion mechanism is employed.

Between the bundle conveying upper guide plate 207 and the bundle conveying lower guide plate 208, i.e., at the approximate center of the center-folding conveying path 243, the folding plate 215, the folding roller pair 230, the folding-enhancement roller unit 260, and the lower discharging rollers 231 are provided. The folding-enhancement roller unit 260 has folding-enhancement rollers arranged over and under the paper discharging conveying path between the folding roller pair 230 and the lower discharging rollers 231 to interpose the paper discharging conveying path. The folding plate 215 can reciprocate in the horizontal direction in the drawing, and in the direction of the folding operation thereof, a nip of the folding roller pair 230 is positioned, and a paper discharging conveying path 244 is disposed on the extension line of that direction. The lower discharging rollers 231 are provided at the most downstream of the paper discharging conveying path 244 and discharge the folded sheet bundle to the subsequent stage.

At a lower end of the bundle conveying upper guide plate 207, a sheet bundle detecting sensor 291 is provided for detecting the end of the sheet bundle which is conveyed into the center-folding conveying path 243 and passes the center-folding position. At the paper discharging conveying path 244, a fold part passing sensor 293 for detecting the end of the center-folded sheet bundle and recognizing the passage of the sheet bundle is provided.

Roughly speaking, in the saddle-stitching bookbinding apparatus 2 configured as depicted in FIG. 1, the saddle-stitching and center-folding operation is performed as depicted in the operation explanatory diagrams of FIG. 2 to FIG. 6. In other words, if the saddle-stitching and center-folding are selected on an operation panel, which is not illustrated, in the image forming apparatus PR, the sheet bundle for which saddle-stitching and center-folding are selected is guided toward the center-folding conveying path 243 by virtue of the counterclockwise biasing operation of the branch claw 202. The branch claw 202 is driven by a solenoid. Alternatively, motor driving may be employed instead of the solenoid.

Figure 2:
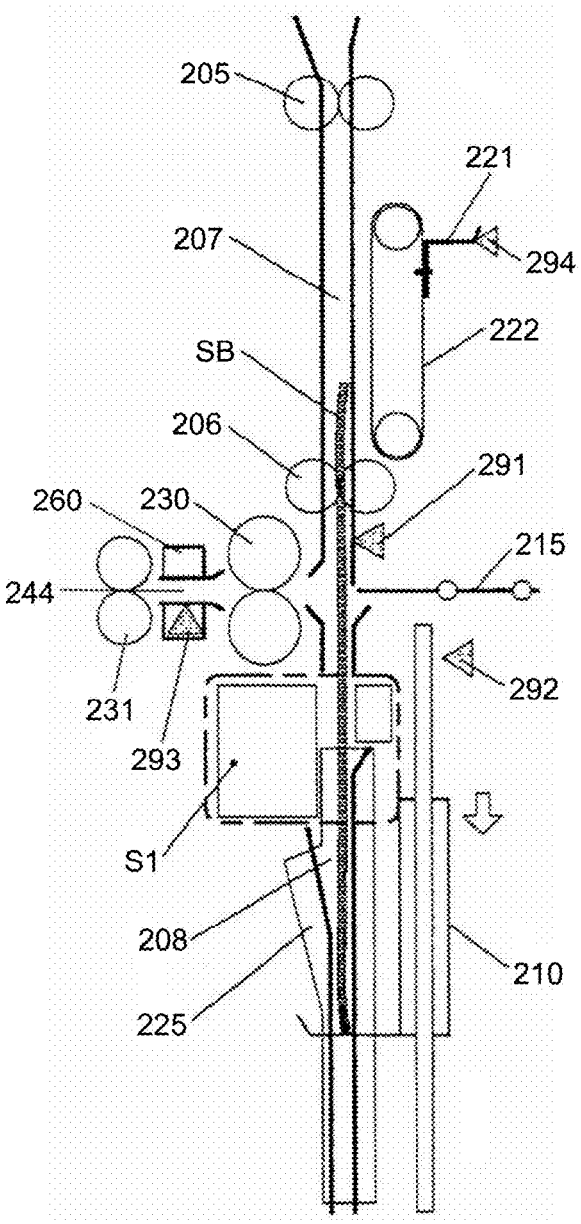
FIG. 2 is an explanatory diagram of the operation of a saddle-stitching bookbinding apparatus, illustrating the state in which a sheet bundle is conveyed into a center-folding conveying path.

The sheet bundle SB conveyed into the center-folding conveying path 243 is conveyed downward along the center-folding conveying path 243 by the entrance rollers 201 and the bundle conveying upper rollers 205, and after the passage of the sheet bundle SB is confirmed by the sheet bundle detecting sensor 291, the sheet bundle SB is conveyed to the position where the end of the sheet bundle SB abuts on the movable fence 210 by the bundle conveying lower rollers 206 as depicted in FIG. 2. On this occasion, the movable fence 210 stands-by at a different stop position depending on the sheet size information from the image forming apparatus PR, here, the size information of each sheet bundle SB in the conveying direction. In FIG. 2, the bundle conveying lower rollers 206 nip the sheet bundle SB at the nip and the trailing-end hitting claw 221 stands-by at the home position.

Figure 3:
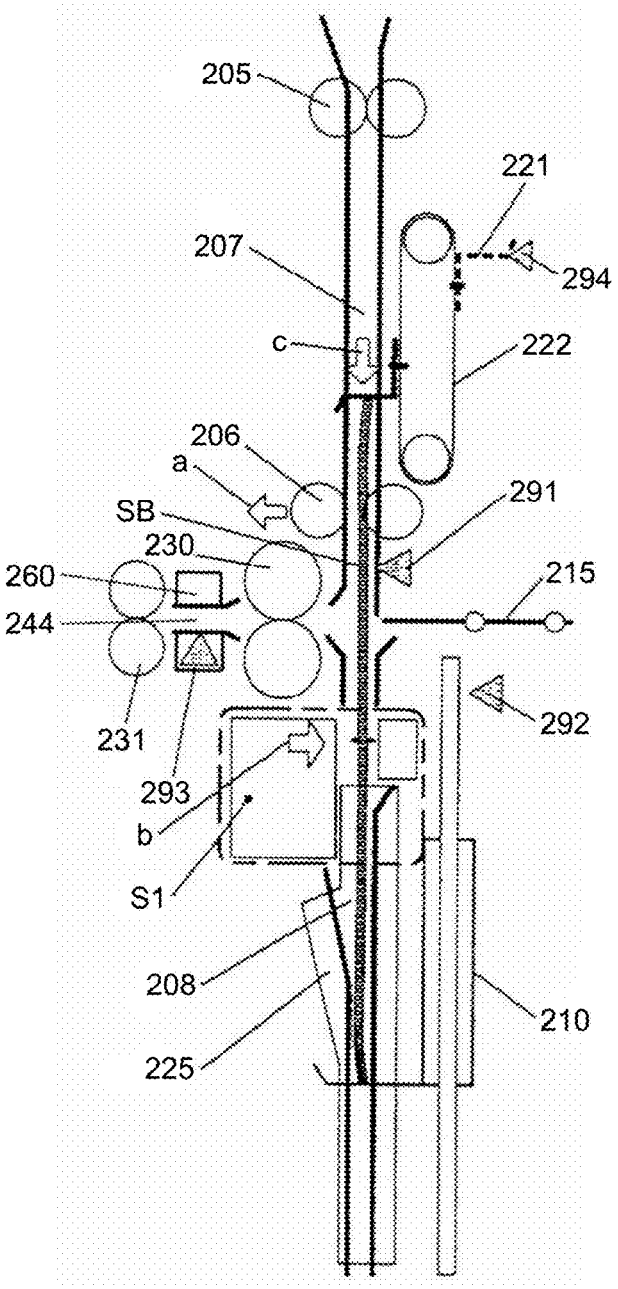
FIG. 3 is an explanatory diagram of the operation of the saddle-stitching bookbinding apparatus, illustrating the state in which the sheet bundle is saddle-stitched.

In this state, the nip pressure of the bundle conveying lower rollers 206 is released as depicted in FIG. 3 (direction of arrow a), the end of the sheet bundle abuts on the movable fence 210, and the sheet bundle is stacked in the state in which the trailing end is free; then, the trailing-end hitting claw 221 is driven to hit the trailing end of the sheet bundle SB to align the bundle in the conveying direction finally (direction of arrow c).

Next, the aligning operation in the width direction (direction orthogonal to the sheet conveying direction) is performed by the saddle-stitching jogger fence 225 and the aligning operation in the conveying direction is performed by the movable fence 210 and the trailing-end hitting claw 221; thus, the aligning operation in the width direction and the conveying direction of the sheet bundle SB is completed. On this occasion, the amount of pushing the trailing-end hitting claw 221 and the saddle-stitching jogger fence 225 is changed to an optimal value according to the sheet size information, the information of the number of sheets included in the sheet bundle, and the sheet bundle thickness information, for aligning.

If the bundle is thick, the space in the conveying path is small; therefore, the alignment is often insufficient by one alignment operation. In such cases, the number of times of the alignment is increased. Thus, a better aligned state can be achieved. Moreover, since the time for sequentially stacking the sheets at the upstream is longer as the number of sheets is larger, the time taken until the next sheet bundle is received becomes longer. As a result, even though the number of times of the alignment is increased, the time is not wasted as a system; therefore, a favorable aligned state can be achieved efficiently. Accordingly, it is also possible to control the number of times of the alignment in accordance with the upstream process time.

The standby position of the movable fence 210 is usually set to the saddle-stitching position of the sheet bundle SB that is the opposite position to the stapling position of the saddle-stitching stapler S1. This is because the alignment at this position enables the binding at the stacked position without moving the movable fence 210 to the saddle-stitching position of the sheet bundle SB. In view of this, at this standby position, the stitcher of the saddle-stitching stapler S1 is driven in a direction of an arrow b at the central part of the sheet bundle SB and the binding process is performed between the stitcher and a clincher, thereby saddle-stitching the sheet bundle SB.

The movable fence 210 is positioned by pulse control from the movable fence HP sensor 292, and the trailing-end hitting claw 221 is positioned by pulse control from the trailing-end hitting claw HP sensor 294. The positioning control for the movable fence 210 and the trailing-end hitting claw 221 is executed by a CPU of a control circuit, which is not illustrated, of the saddle-stitching bookbinding apparatus 2.

Figure 4:
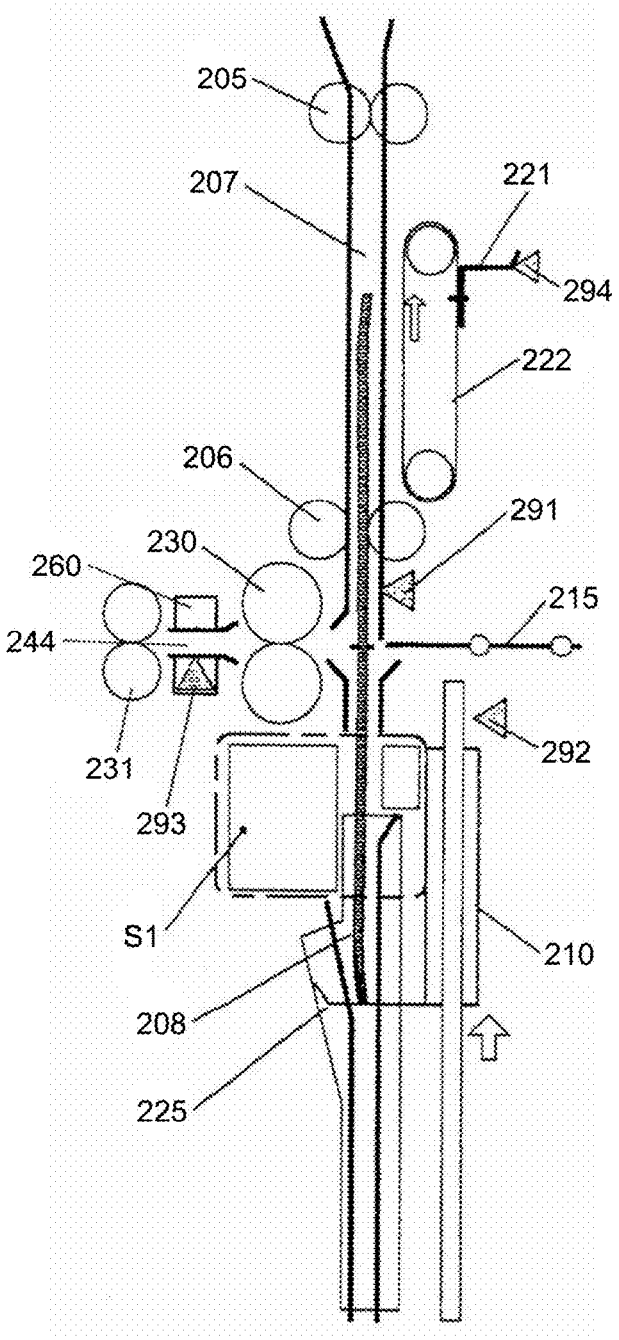
FIG. 4 is an explanatory diagram of the operation of the saddle-stitching bookbinding apparatus, illustrating the state in which the sheet bundle has moved to the center-folding position.

The sheet bundle SB saddle-stitched in the state of FIG. 3 is transferred to the position at which the saddle-stitching position (central position in the conveying direction of the sheet bundle SB) faces the folding plate 215 in conjunction with the upward movement of the movable fence 210 with the pressure application of the bundle conveying lower rollers 206 released as depicted in FIG. 4. This position is also controlled based on the detection position of the movable fence HP sensor 292.

Figure 5:
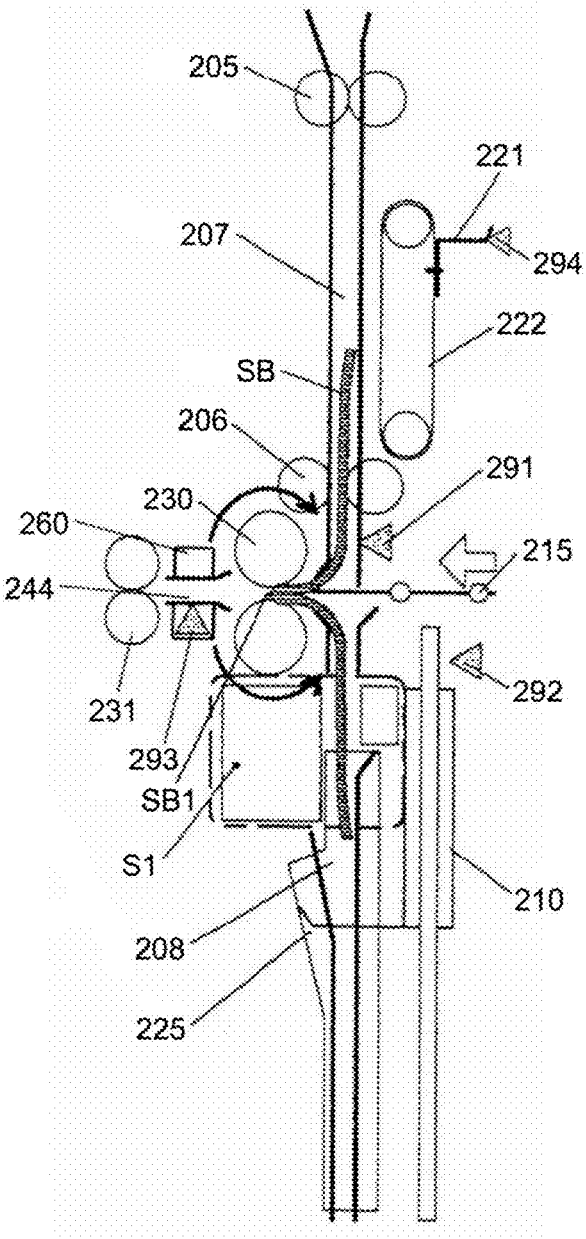
FIG. 5 is an explanatory diagram of the operation of the saddle-stitching bookbinding apparatus, illustrating the state in which the sheet bundle is center-folded.

As the sheet bundle SB reaches the position depicted in FIG. 4, the folding plate 215 moves in the direction toward the nip of the folding roller pair 230 as depicted in FIG. 5; then, the folding plate 215 abuts on the sheet bundle SB in an approximately perpendicular direction at the vicinity of the staple part where the sheet bundle SB is bound, thereby pushing the sheet bundle SB toward the nip. The sheet bundle SB is pushed out by the folding plate 215 toward the nip of the folding roller pair 30, so that the sheet bundle SB is pushed into the nip of the folding roller pair 230 which is in rotation. The folding roller pair 230 presses and conveys the sheet bundle SB pushed into the nip. Through this pressing and conveying operation, the sheet bundle SB is folded at the center, thereby forming the sheet bundle SB which has been provisionally bound. FIG. 5 illustrates the state in which the end of a fold part SB1 of the sheet bundle SB is held and pressed by the nip of the folding roller pair 230.

Figure 6:
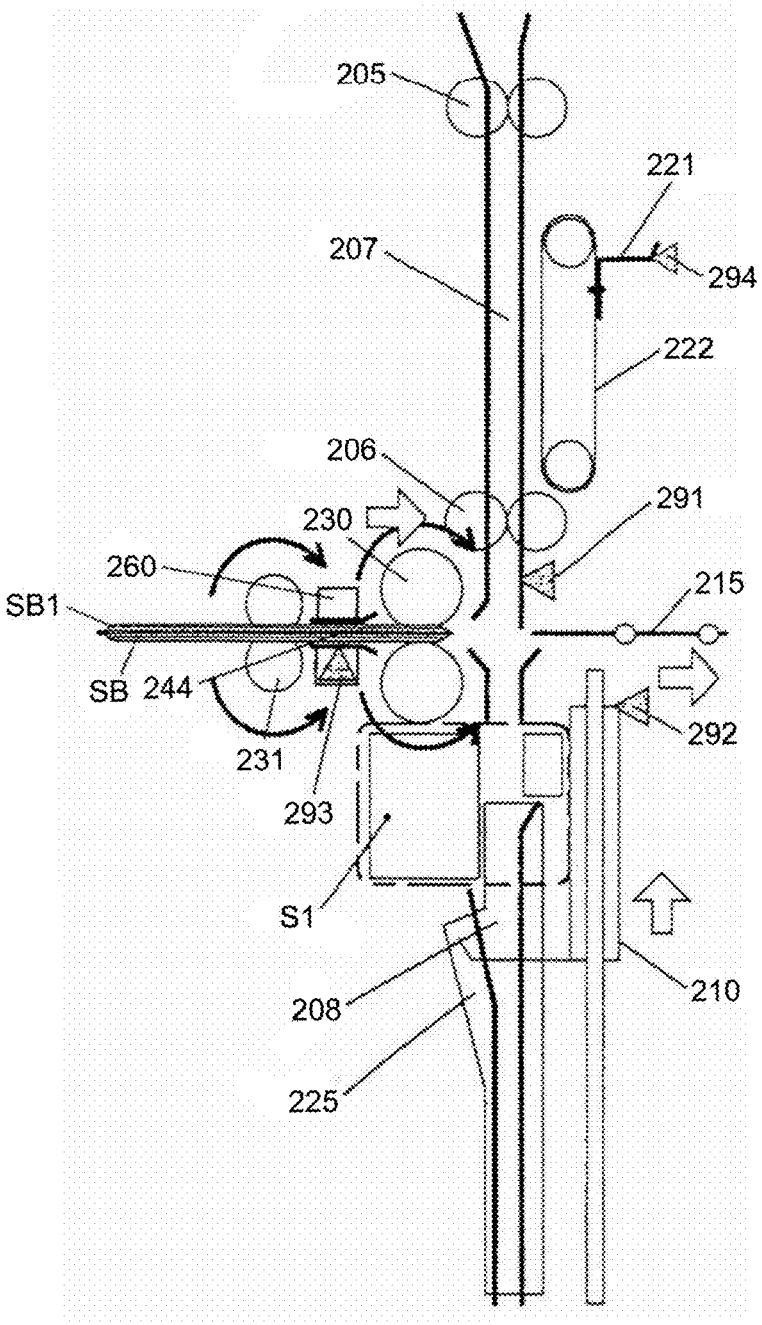
FIG. 6 is an explanatory diagram of the operation of the saddle-stitching bookbinding apparatus, illustrating the state in which the sheet bundle is discharged after the end of the center-folding.

The sheet bundle SB folded in two at the center in the state of FIG. 5 is conveyed by the folding roller pair 230 as the sheet bundle SB as depicted in FIG. 6, and the sheet bundle SB is held by the lower discharging rollers 231 and discharged to the subsequent stage. On this occasion, as soon as the trailing end of the sheet bundle SB is detected by the fold part passing sensor 293, the folding plate 215 and the movable fence 210 return to the respective home positions and the bundle conveying lower rollers 206 returns to the pressing state; thus, the folding plate 215, the movable fence 210, and the bundle conveying lower rollers 206 stand-by for the arrival of the next sheet bundle SB. If the size and the number of sheets are the same in the next job, the movable fence 210 may move again to the position depicted in FIG. 2 and stand-by at that position. Note that the control thereof may also be executed by the CPU of the control circuit.

Figure 7:
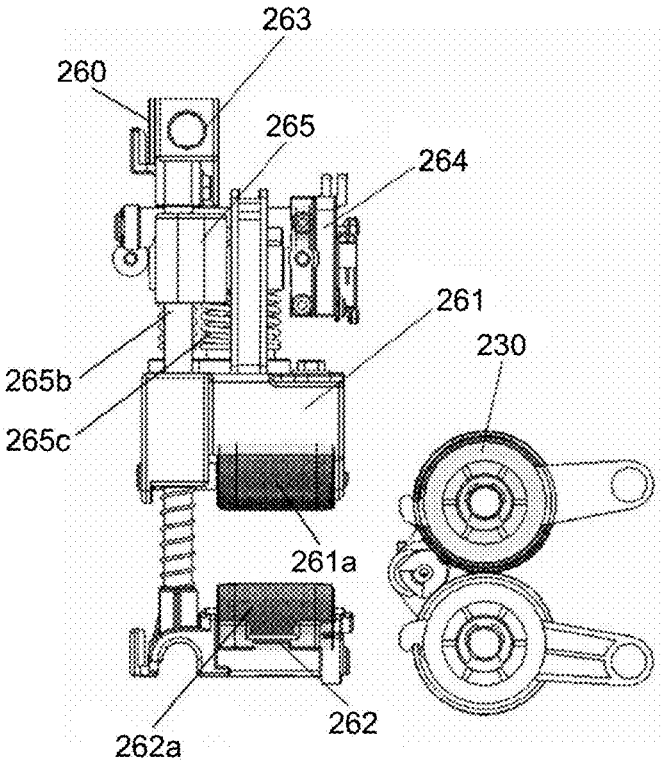
FIG. 7 is a front view of a main part, illustrating a folding-enhancement roller unit and a folding roller pair.
Figure 8:
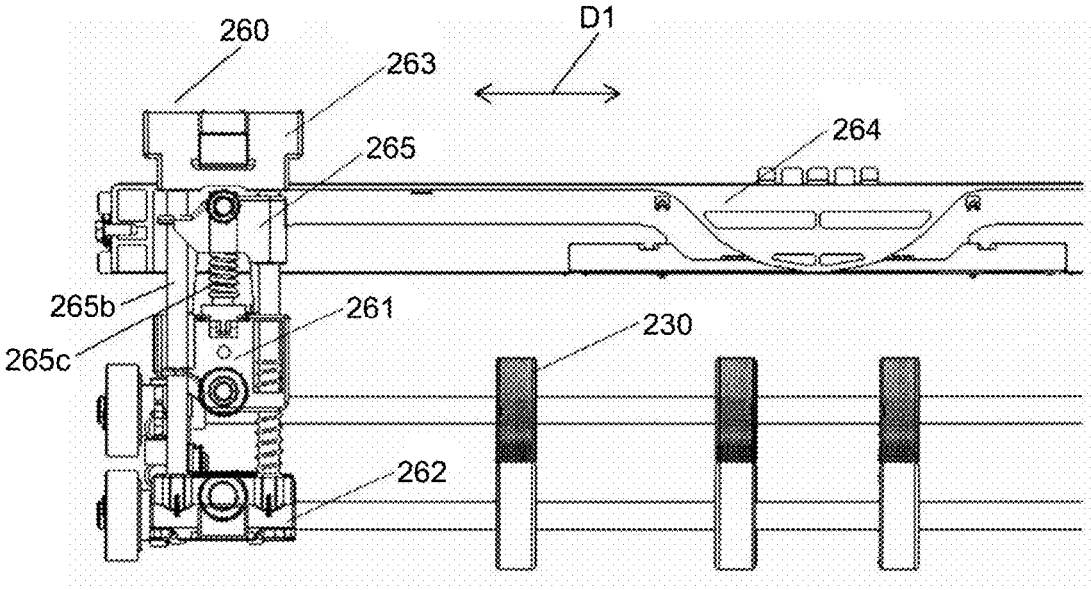

FIG. 7 is a front view of the main part, illustrating the folding-enhancement roller unit and the folding roller pair, and FIG. 8 is a side view of the main part, in which FIG. 7 is seen from the left side. The folding-enhancement roller unit 260 is provided at the paper discharging conveying path 244 between the folding roller pair 230 and the lower discharging rollers 231, and includes a unit movement mechanism 263, a guide member 264, and a pressing mechanism 265. The unit movement mechanism 263 causes the folding-enhancement unit 260 to reciprocate along the guide member 264 in a depth direction in the drawing (direction orthogonal to the sheet conveying direction) by a driving source and a driving mechanism, which are not illustrated. The pressing mechanism 265 is a mechanism for pressing the sheet bundle SB by applying pressure from the upper and lower direction, and includes a folding-enhancement roller/upper unit 261 and a folding-enhancement roller/lower unit 262.

The folding-enhancement roller/upper unit 261 is supported by a support member 265*b* so as to be horizontally movable relative to the unit movement mechanism 263, and the folding-enhancement roller/lower unit 262 is attached to a lower end of the support member 265*b* of the pressing mechanism 265 so as to be unmovable. An upper folding-enhancement roller 261*a* of the folding-enhancement roller/upper unit 261 can be in pressure contact with a lower folding-enhancement roller 262*a*, and the both apply pressure to the sheet bundle SB with the sheet bundle SB interposed in the nip between the both. The pressure force is applied by a pressing spring 265*c* which presses the folding-enhancement roller/upper unit 261 with elastic force. The movement in the width direction the sheet bundle SB (direction of D1 in FIG. 8) is performed in the pressing state as later described, and then folding-enhancement is performed on the fold part SB1.

Figure 9:
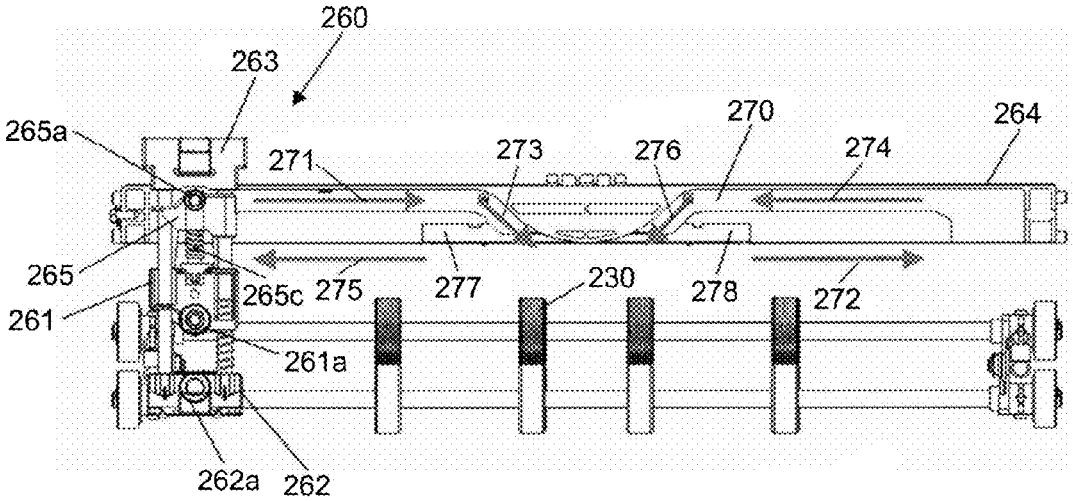
FIG. 9 illustrates the details of a guide member.

FIG. 9 illustrates the details of the guide member 264. The guide member 264 includes a guide route 270 for guiding the folding-enhancement roller unit 260 in the width direction of the sheet bundle SB. The guide route 270 includes the following six routes:

1) a first guide route 271 for guiding the pressing mechanism 265 in the pressure-released state during advancing movement;

2) a second guide route 272 for guiding the pressing mechanism 265 in the pressed state during the advancing movement;

3) a third guide route 273 for changing the state of a pressing mechanism 265 from the pressure-released state to the pressed state during the advancing movement;

4) a fourth guide route 274 for guiding the pressing mechanism 265 in the pressure-released state during the return movement;

5) a fifth guide route 275 for guiding the pressing mechanism 265 in the pressed state during the return movement; and 6) a sixth guide route 276 for changing the state of the pressing mechanism 265 from the pressure-released state to the pressed state during the return movement.

Figure 10:
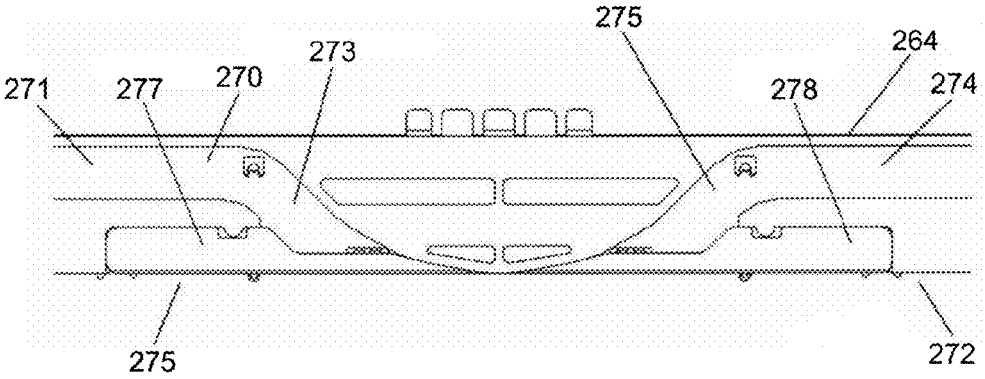
FIG. 10 is a magnified view of a main part of FIG. 9, illustrating the state in which a route changeover claw is not changed.
Figure 11:
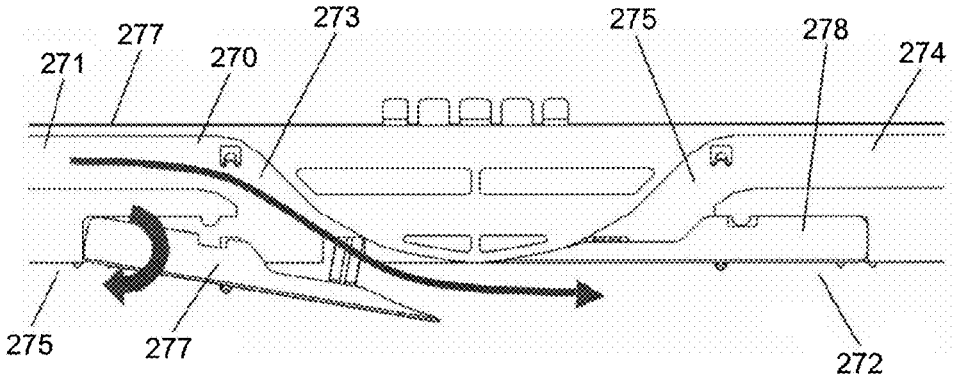
FIG. 11 is a magnified view of the main part of FIG. 9, illustrating the state in which a first route changeover claw has been changed.

FIG. 10 and FIG. 11 are magnified views of the main part of FIG. 9. A first route changeover claw 277 and a second route changeover claw 278 are provided at an intersection between the third guide route 273 and the second guide route 272 and at an intersection between the sixth guide route 276 and the fifth guide route 275, respectively as illustrated in FIG. 10 and FIG. 11. The first route changeover claw 277 allows the changeover from the third guide route 273 to the second guide route 272 and the second route changeover claw 278 allows the changeover from the sixth guide route 276 to the fifth guide route 275 as depicted in FIG. 11. However, the changeover from the second guide route 272 to the third guide route 273 in the former and the changeover from the fifth guide route 275 to the sixth guide route 276 in the latter are impossible. In other words, the changeover in the reverse direction is not allowed. An arrow in FIG. 11 indicates the movement locus of a guide pin 265*a*.

The pressing mechanism 265 moves along the guide route 270 because the guide pin 265*a* of the pressing mechanism 265 is movably fitted in the guide route 270 in a manner that the guide pin 265*a* is loosely fitted in the guide route 270. In other words, the guide route 270 functions as a cam groove, and the guide pin 265*a* functions as a cam follower that changes a position during the movement along this cam groove.

FIG. 12 to FIG. 22 are operation explanatory views of the folding-enhancement operation of the folding-enhancement roller unit in this embodiment.

Figure 12:
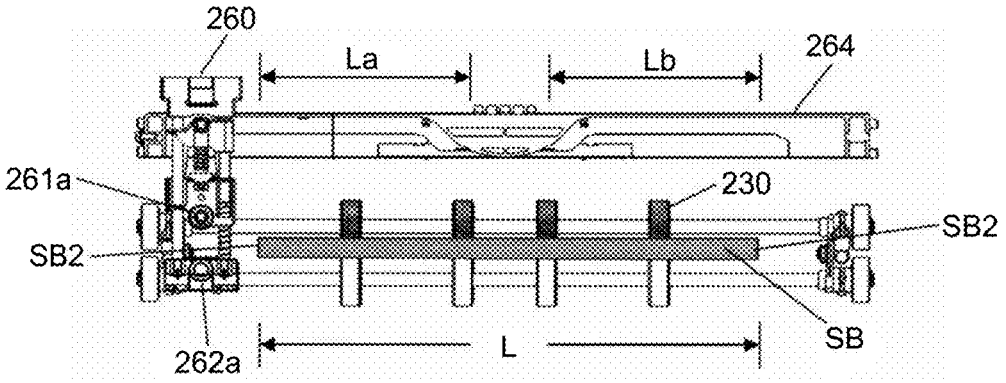
FIG. 12 is an explanatory diagram of the operation, illustrating the initial state of the folding-enhancement operation.
Figure 13:
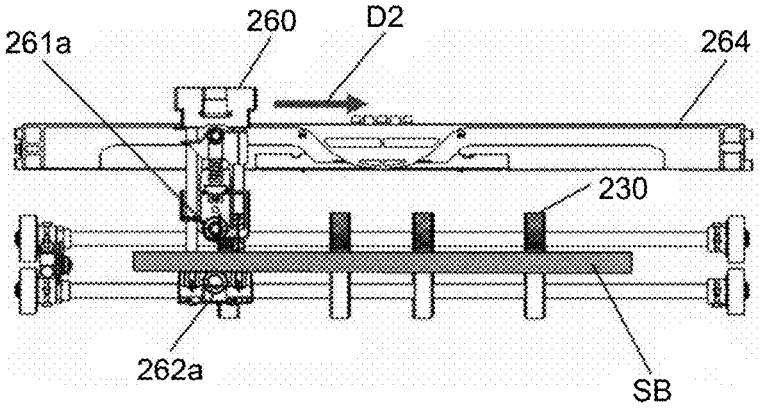
FIG. 13 is an explanatory diagram of the operation, illustrating the state in which the advancing movement of the folding-enhancement roller unit is started.
Figure 14:
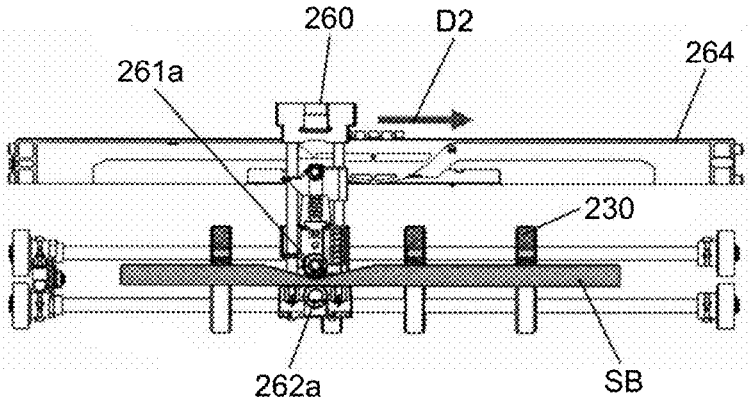
FIG. 14 is an explanatory diagram of the operation, illustrating the state in which the folding-enhancement roller unit reaches a third guide route near the center of the sheet bundle.

FIG. 12 illustrates the state in which the sheet bundle SB folded by the folding rollers 230 is conveyed to and stopped at a predetermined folding-enhancement position and the folding-enhancement roller unit 260 is in the standby position. This is the initial position of the folding-enhancement operation.

The folding-enhancement roller unit 260 starts to advance (FIG. 13) in the right direction in the drawing (direction of arrow D2) from the initial position (FIG. 12). On this occasion, the pressing mechanism 265 in the folding-enhancement roller unit 260 moves along the guide route 270 of the guide member 264 by the action of the guide pin 265*a*. Just after the start of the operation, the pressing mechanism 265 moves along the first guide route 271. On this occasion, the folding-enhancement roller pair 261*a* and 262*a* is in the pressure-released state. Here, the pressure-released state refers to the state in which the folding-enhancement rollers 261*a* and 262*a* and the sheet bundle SB are in contact with each other but are subjected to almost no pressure, or the state in which the folding-enhancement rollers 261*a* and 262*a* and the sheet bundle SB are separated from each other.

Figure 15:
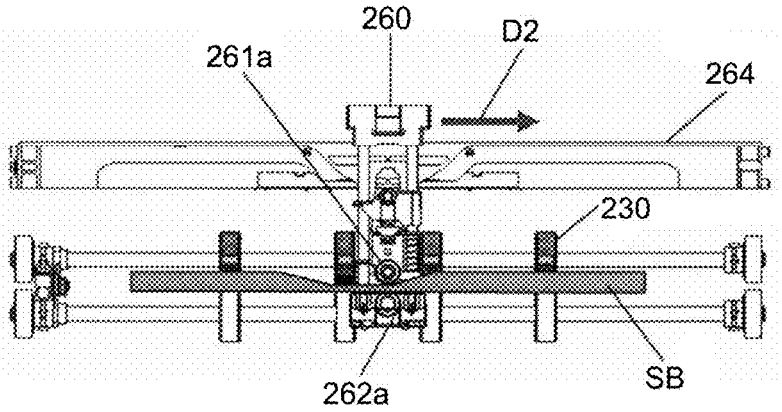
FIG. 15 is an explanatory diagram of the operation, illustrating the state in which the folding-enhancement roller unit has pushed away the first route changeover claw and entered a second guide route.

As soon as the folding-enhancement roller unit 260 reaches the third guide route 273 near the center of the sheet bundle SB (FIG. 14), the pressing mechanism 265 starts to go down along the third guide route 273 and the folding-enhancement roller unit 260 pushes away the first route changeover claw 277 and enters the second guide route 272 (FIG. 15). On this occasion, the pressing mechanism 265 presses the folding-enhancement roller/upper unit 261, and the folding-enhancement roller/upper unit 261 abuts on the sheet bundle SB, so that the pressed state is reached.

Figure 16:
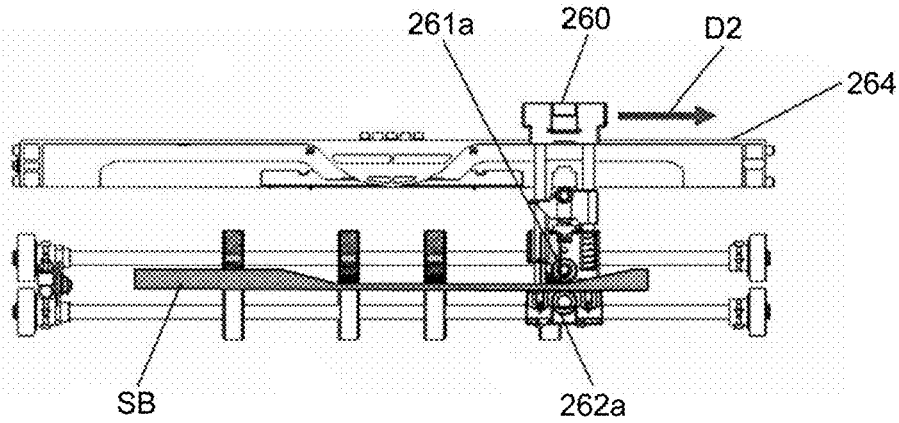
FIG. 16 is an explanatory diagram of the operation, illustrating the state in which the folding-enhancement roller unit moves in a direction toward the end while pressing the sheet bundle.
Figure 17:
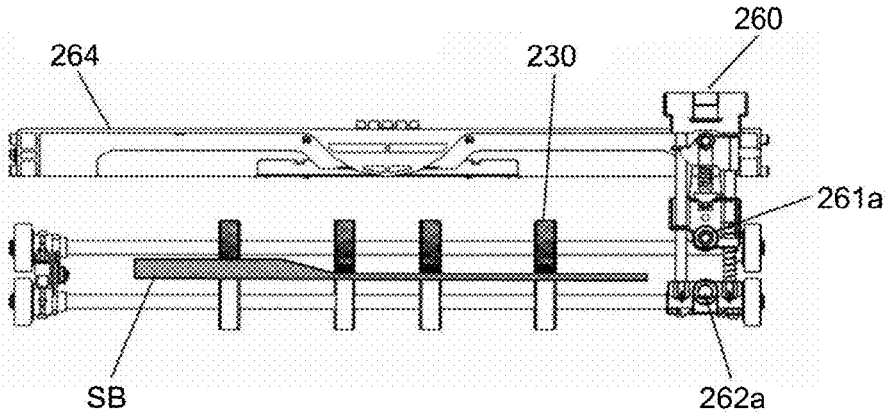
FIG. 17 is an explanatory diagram of the operation, illustrating the state in which the folding-enhancement roller unit has moved to the final position of the advancing movement along the second guide route.

While the pressed state is maintained, the folding-enhancement roller unit 260 further moves in the direction of arrow D2 (FIG. 16). Here, since the second route changeover claw 278 does not allow the reverse changeover, the folding-enhancement roller unit 260 is not guided to the sixth guide route 276 and moves along the second guide route 272, goes past the sheet bundle SB and reaches the final position of the advancing movement (FIG. 17). After the movement up to this position, the guide pin 265*a* of the pressing mechanism 265 transfers from the second guide route 272 to the fourth guide route 274 at the upper. As a result, the positional restriction of the guide pin 265*a* by virtue of the upper surface of the second guide route 272 is released; therefore, the upper folding-enhancement roller 261*a* is separated from the lower folding-enhancement roller 262*a*, and the pressure-released state is reached.

Figure 18:
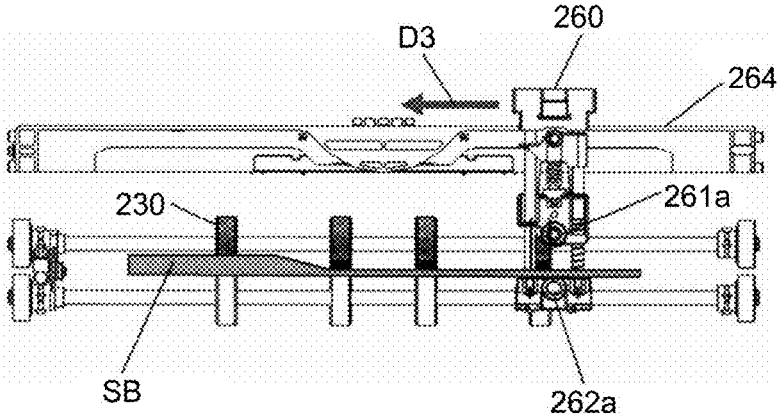
FIG. 18 is an explanatory diagram of the operation, illustrating the state in which the folding-enhancement roller unit has started the return movement from the final position of the advancing movement.
Figure 19:
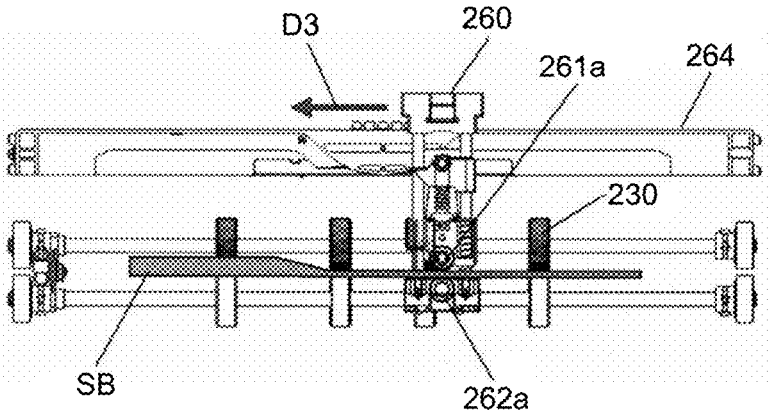
FIG. 19 is an explanatory diagram of the operation, illustrating the state in which the folding-enhancement roller unit has started the return movement and reached a sixth guide route.
Figure 20:
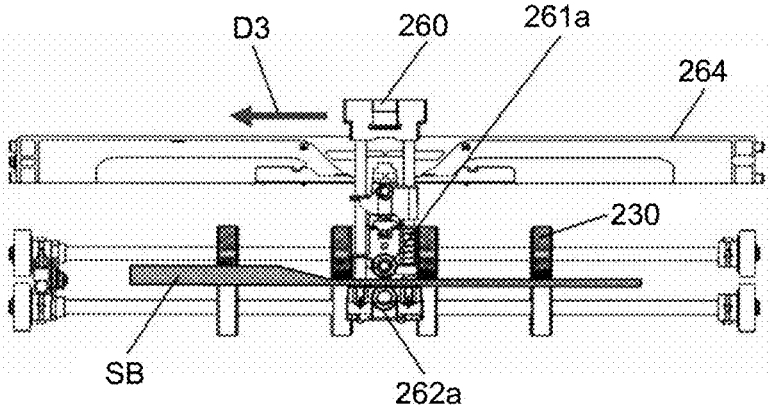
FIG. 20 is an explanatory diagram of the operation, illustrating the state in which the folding-enhancement roller unit has reached the sixth guide route and transited from the pressure-released state to the pressed state.
Figure 21:
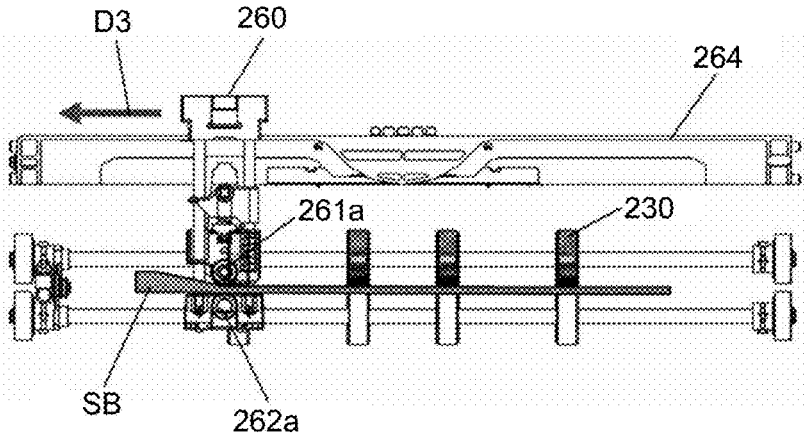
FIG. 21 is an explanatory diagram of the operation, illustrating the state in which the folding-enhancement roller unit has entered the fifth guide route and the fully pressed state has been reached.

Next, the folding-enhancement roller unit 260 starts to return by the unit movement mechanism 263 (FIG. 18). In the return movement, the pressing mechanism 265 moves in the left direction in the drawing (direction of arrow D3) along the fourth guide route 274. As the pressing mechanism 265 reaches the sixth guide route 276 by this movement (FIG. 19), the guide pin 265*a* is pushed downward along the shape of the sixth guide route 276 and the pressing mechanism 265 transits from the pressure-released state to the pressed state (FIG. 20).

Figure 22:
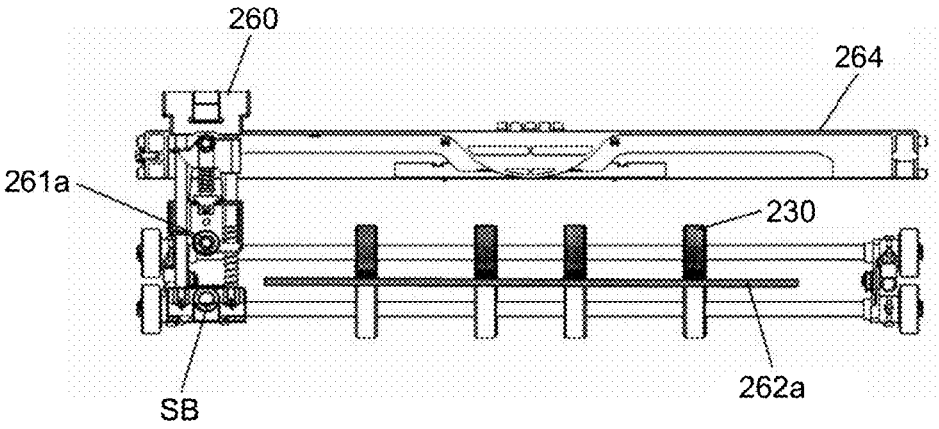
FIG. 22 is an explanatory diagram of the operation, illustrating the state in which the folding-enhancement roller unit has moved along the fifth guide route and returned to the initial position.

Then, in the fifth guide route 275, the fully-pressed state is reached. The folding-enhancement roller unit 260 continuously moves in the direction of arrow D3 along the fifth guide route 275 (FIG. 21) and goes past the sheet bundle SB (FIG. 22).

In this manner, by the reciprocation of the folding-enhancement roller unit 260, the sheet bundle SB is folding-enhanced. On this occasion, the folding-enhancement roller unit 260 starts the folding-enhancement toward one side of the sheet bundle SB from the central part and then, goes past the one end SB2 of the sheet bundle SB. After that, the folding-enhancement roller unit 260 passes over the folding-enhanced sheet bundle SB, starts the folding-enhancement toward the other side of the sheet bundle from the central part, and then, goes past the other one end SB2 of the sheet bundle SB.

Through such operation, when starting the folding-enhancement, or when returning from one end to the other end, the folding-enhancement roller pair 261*a* and 262*a* is not brought into contact with or does not apply pressure to the end SB2 of the sheet bundle SB from the outside of the sheet bundle SB. In other words, the folding-enhancement roller unit 260 is in the pressure-released state when passing the end SB2 of the sheet bundle SB from the outside of the end; therefore, the end SB2 of the sheet bundle SB is not damaged. Moreover, since the folding-enhancement is performed from the vicinity of the central part of the sheet bundle SB to the end SB thereof, the distance over which the folding-enhancement roller unit 260 runs in contact with the sheet bundle SB during the folding-enhancement is shortened; as a result, a twist that would cause the crease or the like is not easily accumulated. Therefore, when the fold part (back) SB1 of the sheet bundle SB is folding-enhanced, the end SB2 of the sheet bundle SB is not damaged and the generation of crease or the curl at or near the fold part SB1 due to the accumulation of the twist can be suppressed.

For preventing the folding-enhancement roller pair 261*a* and 262*a* from running on the end SB2 of the sheet bundle SB from the outside of the end SB2, as can be seen from the operation of FIG. 12 to FIG. 22, it is necessary to satisfy the relation L>La+Lb, where La is the distance over which the folding-enhancement roller unit 260 moves over the sheet bundle in the pressure-released state during the advancing movement, Lb is the distance over which the folding-enhancement roller unit 260 moves over the sheet bundle in the pressure-released state during the return movement, and L is the length of the sheet bundle in the width direction (FIG. 12 to FIG. 14, and FIG. 17 to FIG. 19).

It is desirable that the distances La and Lb are approximately the same and pressing is started near the central part of the width direction of the sheet bundle SB (FIG. 16 and FIG. 20).

In this embodiment, the folding-enhancement roller unit 260 includes the folding-enhancement roller/lower unit 262 to cause the folding-enhancement roller pair 261*a* and 262*a* to perform the folding-enhancement; however, the folding-enhancement roller/lower unit 262 may be omitted and the folding-enhancement roller/upper unit 261 and a reception member, which is not illustrated, having a contact surface facing the folding-enhancement roller/upper unit 261 may be provided to apply pressure therebetween.

Further, in the folding-enhancement roller unit 260 in this embodiment, the folding-enhancement roller/upper unit 261 is configured to be movable in the upper and lower direction and the folding-enhancement roller/lower unit 262 is configure to be unmovable in the upper and lower direction; however, the folding-enhancement roller/lower unit 262 may also be configured to be movable in the upper and lower direction. In such a structure, the upper and lower rollers 261*a* and 262*a* are operated symmetrically with respect to the folding-enhancement position so as to contact with or separate from each other; thus, the folding-enhancement position becomes constant regardless of the thickness of the sheet bundle SB and thus damage such as scratch can be further suppressed.

According to this embodiment, the effects as below can be obtained.

1) The sheet processing apparatus includes: the folding plate 215 for folding the sheet bundle SB; the folding roller pair 230; the folding-enhancement roller unit 260 including the pressing mechanism 265 which presses the fold part SB1 of the folded sheet bundle SB in the thickness direction of the sheet bundle SB and enhances folding of the sheet bundle SB; and the unit movement mechanism 263 for advancing and returning the folding-enhancement roller unit 260 in the width direction of the sheet bundle SB, in which the folding-enhancement roller unit 260 starts the pressing from a predetermined position in the width direction of the sheet bundle SB in the advancing movement, stops the pressing after going past one end SB2 of the sheet bundle SB, and then, starts the pressing from the predetermined position in the return movement and goes past the other end SB2 of the sheet bundle SB. Thus, when the folding-enhancement roller unit 260 comes from the outside of the end SB2 of the sheet bundle SB to press the sheet bundle SB, the folding-enhancement roller unit 260 is normally in the pressure-released state; therefore, the end SB2 of the sheet bundle SB is not damaged during the folding-enhancement of the fold part SB1 of the sheet bundle. Further, the entire region of the sheet bundle in the width direction is not folding-enhanced at a time, the generation of curl or crease at or near the fold part due to the accumulation of the twist can be suppressed.

2) The guide member 264 for regulating the start and release of the pressing of the folding-enhancement roller unit 260 is provided, and the folding-enhancement roller unit 260 is moved along the guide route 270 of the guide member 264 by the unit movement mechanism 263. Thus, the pressing can be started or released in the process of the movement.

3) The guide member 264 includes the first and second route changeover claws 277 and 278 for changing the route. Since the pressing and the pressure release can be changed by changeover of the route by the first and second route changeover claws 277 and 278, the changeover operation of starting and releasing the pressing can be performed only by moving along the route.

4) The guide route 270 includes the first to sixth guide routes 271 to 276 which function as the cam grooves. Therefore, the pressing can be started or released at stable position and timing.

5) The relation L>La+Lb is satisfied, where La is a distance over which the folding-enhancement roller unit moves on the sheet bundle in the pressure-released state during the advancing movement, Lb is a distance over which the folding-enhancement roller unit moves on the sheet bundle in the pressure-released state during the return movement, and L is the length of the sheet bundle in the width direction of the sheet bundle. Therefore, the effect of 1) described above can be surely obtained.

6) A symmetric shape can be obtained by setting the distances La and Lb to be approximately the same and configuring such that the pressing is started near the central part of the sheet bundle SB in the width direction. This makes it possible to reduce the manufacturing cost.

7) Since the folding-enhancement roller unit 260 includes the folding-enhancement roller pair 261*a* and 262*a* rotatably supported by the support member, the folding-enhancement can be performed by the rotation of the rollers 261*a* and 262*a*.

8) Since the folding-enhancement rollers 261*a* and 262*e* are each supported by the support member so as to be movable in the pressing direction, the upper and lower rollers 261*a* and 262*a* operate to contact with or separate from each other symmetrically with respect to the folding-enhancement position. Thus, the folding-enhancement position becomes constant regardless of the thickness of the sheet bundle SB. As a result, the damage such as scratch can be suppressed further.

9) Since the folding-enhancement roller unit 260 includes the upper folding-enhancement roller 261*a* rotatably supported and the reception member disposed to face the upper folding-enhancement roller 261*a*, the lower folding-enhancement roller 262*a* can be omitted, which can reduce the cost.

The sheet bundle in the claims corresponds to the reference symbol SB, the folding unit corresponds to the folding plate 215 and the folding roller pair 230, the fold part corresponds to the reference symbol SB1, the pressing unit corresponds to the folding-enhancement roller unit 260 including the pressing mechanism 265, the moving unit corresponds to the unit movement mechanism 263, the guide unit corresponds to the guide member 264, the route corresponds to the guide route 270, the changeover unit corresponds to the first and second route changeover claws 277 and 278, the first guide route corresponds to the reference symbol 271, the second guide route corresponds to the reference symbol 272, the third guide route corresponds to the reference symbol 273, the fourth guide route corresponds to the reference symbol 274, the fifth guide route corresponds to the reference symbol 275, the sixth guide route corresponds to the reference symbol 276, the support member corresponds to the reference symbol 265*b*, the sheet processing apparatus corresponds to the saddle-stitching bookbinding apparatus (second sheet post-processing apparatus) 2, and the image forming system corresponds to the system including the saddle-stitching bookbinding apparatus 2 and the image forming apparatus PR in this embodiment.

Further, the present invention is not limited to the embodiment described above, and various modifications can be made within the content of the present invention. All the technical matters included in the technical idea described in the scope of claims are the subject of the present invention. The embodiment is a preferred example, and a person skilled in the art would conceive various kinds of alternatives, corrections, modifications, or improvements on the basis of the disclosure of the present specification, and these are included in the technical range described in the attached scope of claims.

According to the embodiment, the curl or crease generated at or near the fold part due to the accumulation of the twist can be suppressed without damaging the end of the sheet bundle when the fold part of the sheet bundle is folding-enhanced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a folding unit configured to fold a sheet bundle;

a pressing unit configured to press a fold part of the sheet bundle, subsequent to folding by the folding unit, in a thickness direction of the sheet bundle to enhance folding of the fold part;

a moving unit configured to advance and return the pressing unit in a width direction of the sheet bundle; and a guide unit configured to regulate beginning and releasing of pressing the pressing unit, wherein the pressing unit is configured to move along a route of the guide unit, via the moving unit, wherein:

the pressing unit is configured to begin pressing subsequent to advancement past one end of the sheet bundle, the guide unit includes a changeover unit configured to change the route, and the beginning of pressing and the release of pressing are changeable by changeover of the route via the changeover unit.

2. The sheet processing apparatus according to claim 1, wherein the route of the guide unit includes:

a first guide route to guide the pressing unit in a pressure-released state during the advancement;

a second guide route to guide the pressing unit in a pressed state during the advancement;

a third guide route to change the pressing unit from the pressure-released state to the pressed state during the advancement;

a fourth guide route to guide the pressing unit in the pressure-released state during a return movement;

a fifth guide route to guide the pressing unit in the pressed state during the return movement; and a sixth guide route to change the pressing unit from the pressure-released state to the pressed state during the return movement.

3. The sheet processing apparatus according to claim 1, wherein the pressing unit includes a pressing roller pair rotatably supported by a support member.

4. The sheet processing apparatus according to claim 3, wherein the pressing roller pair is supported by the support member so that each roller is movable in a pressing direction.

5. A sheet processing apparatus, comprising:

a folding unit configured to fold a sheet bundle;

a pressing unit configured to press a fold part of the sheet bundle, subsequent to folding by the folding unit, in a thickness direction of the sheet bundle to enhance folding of the fold part; and a moving unit configured to advance and return the pressing unit in a width direction of the sheet bundle, wherein:

the pressing unit is configured to begin pressing subsequent to advancement past one end of the sheet bundle, and a relation $L>La+Lb$ is satisfied, where La is a distance over which the pressing unit is configured to move over the sheet bundle in a pressure-released state during the advancement, Lb is a distance over which the pressing unit is configured to move over the sheet bundle in the pressure-released state during a return movement, and L is a length of the sheet bundle in the width direction of the sheet bundle.

6. The sheet processing apparatus according to claim 5, wherein the distances La and Lb are approximately the same and wherein pressing is begun near a central part of the sheet bundle in the width direction.

7. A sheet processing apparatus, comprising:

a folding unit configured to fold a sheet bundle;

a pressing unit configured to press a fold part of the sheet bundle, subsequent to folding by the folding unit, in a thickness direction of the sheet bundle to enhance folding of the fold part; and a moving unit configured to advance and return the pressing unit in a width direction of the sheet bundle, wherein:

the pressing unit is configured to begin pressing subsequent to advancement past one end of the sheet bundle, and is configured to release pressing after advancement past the other end of the sheet bundle, and the pressing unit is configured to begin pressing subsequent to advancement past the other end of the sheet bundle, and is configured to release pressing after advancement past one end of the sheet bundle.

8. An image forming system comprising a sheet processing apparatus, the sheet processing apparatus comprising:

a folding unit configured to fold a sheet bundle;

a pressing unit configured to press a fold part of the sheet bundle, subsequent to folding by the folding unit, in a thickness direction of the sheet bundle to enhance folding of the fold part; and a moving unit configured to advance and return the pressing unit in a width direction of the sheet bundle, wherein:

the pressing unit of the sheet processing apparatus is configured to begin pressing subsequent to advancement past one end of the sheet bundle, and is configured to release pressing after advancement past the other end of the sheet bundle, and the pressing unit is configured to begin pressing subsequent to advancement past the other end of the sheet bundle, and is configured to release pressing after advancement past one end of the sheet bundle.

9. A method of enhancing folding of a sheet bundle in a sheet processing apparatus including a pressing unit configured to press a fold part of the sheet bundle, in a thickness direction of the sheet bundle to enhance folding of the fold part, and a moving unit configured to advance and return the pressing unit in a width direction of the sheet bundle, the method comprising:

advancing the pressing unit, via the moving unit, past one end of the sheet bundle;

pressing, via the pressing unit, the sheet bundle subsequent to the advancement past one end of the sheet bundle;

releasing the pressing after advancement past the other end of the sheet bundle;

beginning pressing subsequent to advancement past the other end of the sheet bundle; and releasing pressing after advancement past one end of the sheet bundle.

* * * * *